US006263524B1

(12) United States Patent
Abdul

(10) Patent No.: US 6,263,524 B1
(45) Date of Patent: Jul. 24, 2001

(54) NOVELTY SHOWER HEAD

(76) Inventor: Tarek A. Abdul, 1901 Winding Oak, Lodi, CA (US) 95242

( * ) Notice: Subject to any disclaimer, the term of this patent is extended or adjusted under 35 U.S.C. 154(b) by 0 days.

(21) Appl. No.: 09/658,711

(22) Filed: Sep. 11, 2000

(51) Int. Cl.[7] ..... B05B 1/00
(52) U.S. Cl. ..... 4/615; 4/661; 239/17
(58) Field of Search ..... 4/615, 661, 675, 4/678, 597, 903; 239/17, 74; D23/222

(56) References Cited

U.S. PATENT DOCUMENTS

| | | | | |
|---|---|---|---|---|
| D. 317,332 | | 6/1991 | Williams et al. . | |
| D. 330,066 | | 10/1992 | Macon, II . | |
| 1,918,874 | | 7/1933 | Shannahan . | |
| 2,900,139 | | 8/1959 | Hensley, Jr. . | |
| 2,968,120 | * | 1/1961 | Reed | 239/17 |
| 2,975,980 | | 3/1961 | Siebert . | |
| 4,340,179 | | 7/1982 | Knapp . | |
| 4,353,139 | | 10/1982 | Wainwright et al. . | |
| 4,364,132 | * | 12/1982 | Robinson | 4/661 |
| 4,821,960 | | 4/1989 | Goldman . | |
| 5,174,506 | | 12/1992 | Scheidler . | |
| 5,274,858 | * | 1/1994 | Berry | 4/903 |
| 5,432,956 | * | 7/1995 | Park | 4/661 |
| 5,562,248 | * | 10/1996 | Khalifka | 4/903 |
| 5,983,411 | * | 11/1999 | Demoret | 4/661 |

* cited by examiner

*Primary Examiner*—Charles R. Eloshway
(74) *Attorney, Agent, or Firm*—Randal D. Homburg

(57) ABSTRACT

The invention is a novelty shower head having a cavity in the wall of the shower head containing objects which move according to the swirl of water through the shower head providing an entertaining display of moving objects while in the shower.

3 Claims, 2 Drawing Sheets

NOVELTY SHOWER HEAD

CROSS REFERENCE TO RELATED APPLICATIONS

None

BACKGROUND OF THE INVENTION

1. Field of Invention

The invention is a novelty shower head having a cavity in the wall of the shower head containing objects which move according to the swirl of water through the shower head providing an entertaining display of moving objects while in the shower.

2. Description of Prior Art

The following United States patents are disclosed herein and incorporated into this application for utility patent. All relate to shower head devices. U.S. Pat. No. 4,353,139 to Wainwright discloses novelty faucet covers which protect the fixtures in a bathroom made of soft, stretch material. A shower head with a decorative covering is disclosed in U.S. Pat. No. 4,821,960 to Goldman having the shower spray emanate from the mouth area of the creature portrayed in the shower head design. In U.S. Pat. No. 2,975,980 to Siebert, a shower head with a compartment for placing soap is disclosed where the user may introduce the soap into the water stream while showering. In inner shower head plastic sleeve inside a conventional shower head is disclosed in U.S. Pat. No. 5,174,506 to Scheidler.

A bathing toy is disclosed in U.S. Pat. No. D 317,332, an ornamental design for a toy pump shower is disclosed. A retractable cover for a shower head confining the shower spray to the pour pattern of a faucet fixture is disclosed in U.S. Pat. No. 2,900,139 to Hensley.

SUMMARY OF THE INVENTION

The primary objective of the invention is to provide a shower head with a chamber in which objects and shapes are located and moved in swirling patterns by the turbulence of flowing water in the shower head.

DESCRIPTION OF THE DRAWINGS

The following drawings are submitted with this utility patent application.

DESCRIPTION OF THE PREFERRED EMBODIMENT

Figure 1:
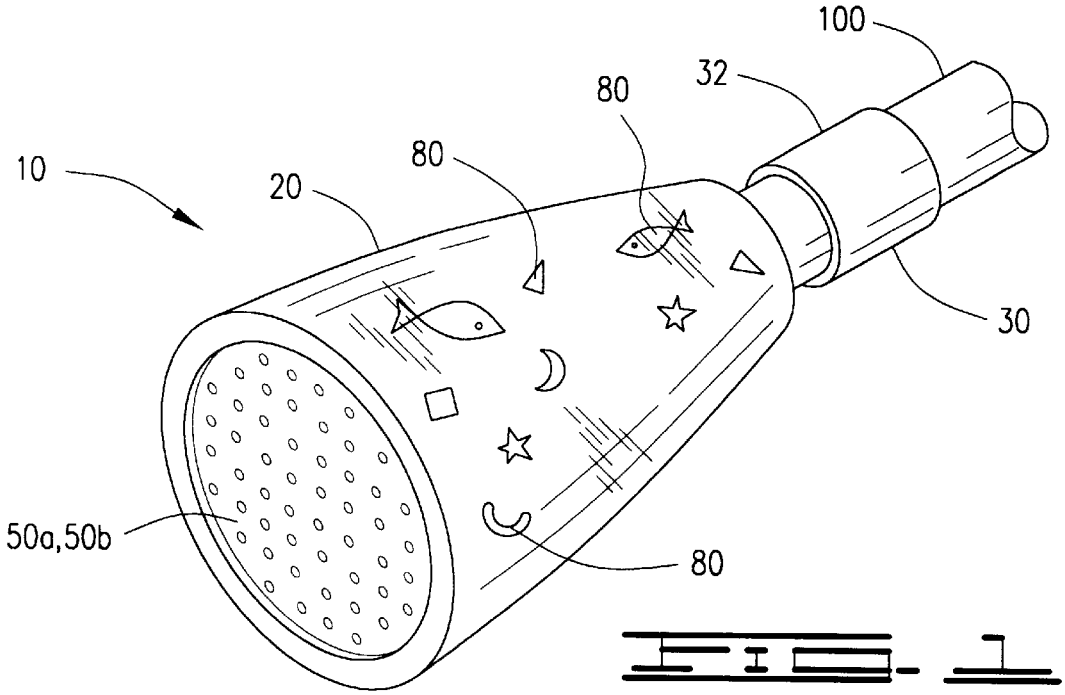
FIG. 1 is a perspective view of the invention.

The invention is a novelty shower head 10 attaching to an outer threaded shower pipe 100, the novelty shower head 10 comprising a transparent outer wall 20 and an inner wall 40 having a turbulence cavity 70 formed between such transparent outer wall 20 and inner wall 40 wherein a plurality of floating objects 80 are placed. The turbulence cavity 70 has a water entry port 72, a plurality of water exit ports 74 and a drain port 76 allowing for complete drainage of the turbulence cavity 70 after use.

Figure 2:
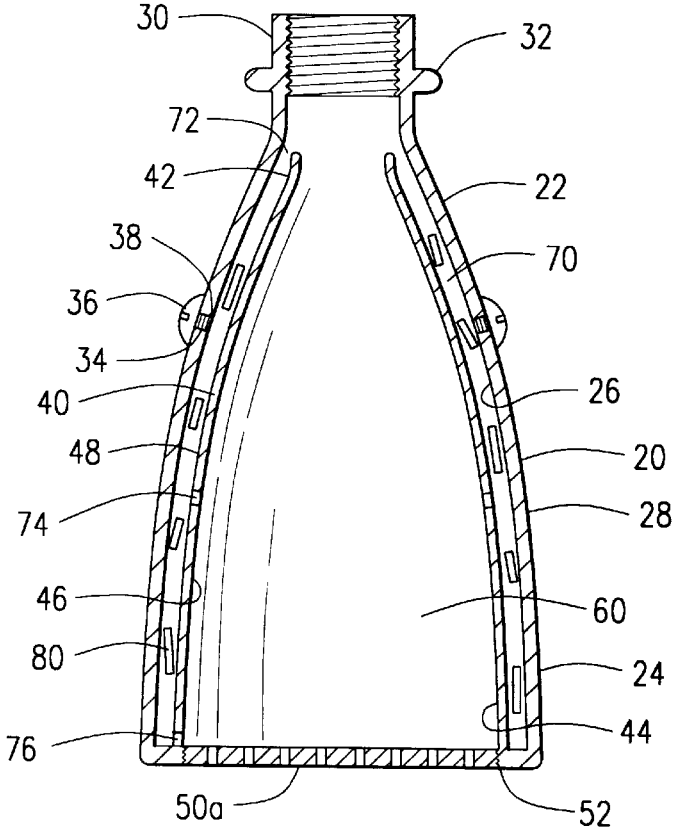
FIG. 2 is a cross section of the first embodiment of the invention.
Figure 3:
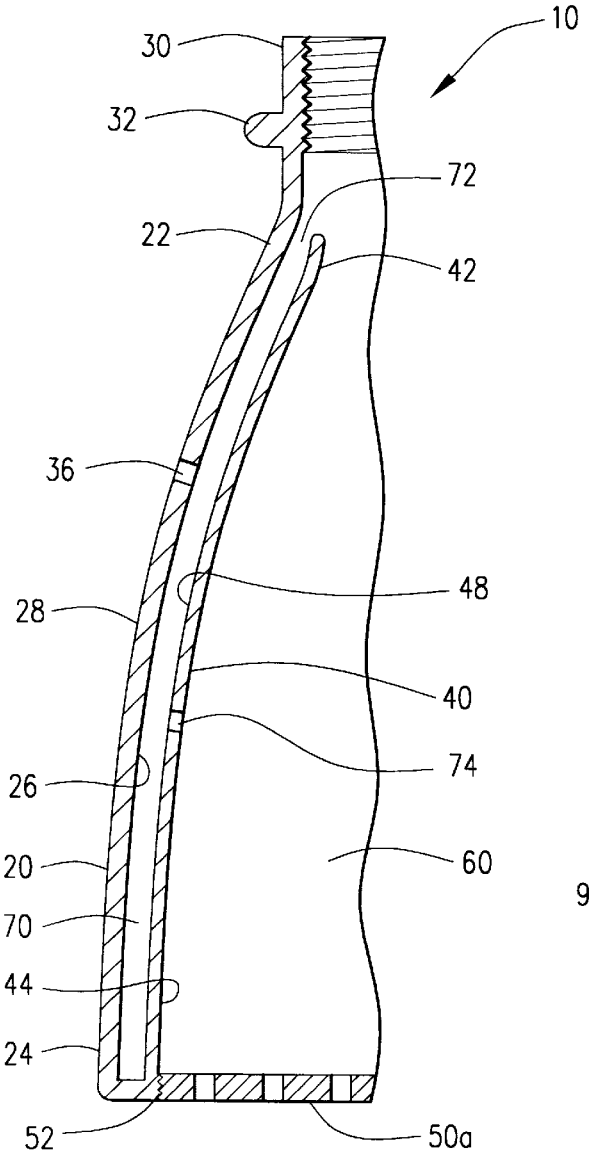
FIG. 3 is a closer cross section of the first embodiment of the invention.

In a first embodiment, as shown in FIGS. 1–3 of the drawings, the transparent outer wall 20 has an upper portion

22, a lower portion 24, an inner surface 26 and an outer surface 28. Located at the upper portion 22 is an internally threaded shower head attachment 30 which accommodates the outer threaded shower pipe 100 supplying the water to the shower in the bathroom. An extended flange 32 is supplied on the internally threaded shower head attachment 30 for use of a tool to apply and tighten the internally threaded shower head attachment 30 to the threaded shower pipe 100.

The outer surface 28 of the transparent outer wall 20 is provided with at least two threaded cleaning port holes 34 which penetrate the transparent outer wall 20 from the inner surface 26 to the outer surface 28 into the turbulence cavity 70. The threaded cleaning port holes 34 have removable plugs 36 engaging inner threads 38 within the threaded cleaning port holes 34.

The inner wall 40 of the invention 10, as shown in FIGS. 2 and 3 of the drawings, has an upper portion 42, a lower portion 44, an inner surface 46 and an outer surface 48. The lower portion 44 of the inner wall 40 is connected to the lower portion 24 of the transparent outer wall 20. The inner surface 26 of the transparent outer wall 20 and the outer surface 48 of the inner wall 40 define the turbulence cavity 70, and the upper portion 42 of the inner wall 40 is closer to the upper portion 22 of the transparent outer wall 20, making the turbulence cavity 70 narrowed towards the upper portion 42 of the inner wall 40. The threaded cleaning port holes 34 allow for the introduction of cleaning liquids into the turbulence cavity 70.

The upper portion 42 of the inner wall 40 is not attached to the transparent outer wall 20, thereby defining the water entry port 72 allowing limited water access to the turbulence cavity 70. The plurality of water exit ports 74 are located between the inner surface 46 and outer surface 48 of the inner wall 40 approximately an equal distance between the upper portion 42 and lower portion 44 of such inner wall 40. A singular drain port 76 is located through the inner wall 40 at the lower portion 44 of the inner wall 40 allowing for full draining of water from the turbulence cavity 70 when the shower is turned off.

The lower portion 44 of the inner surface 46 of the inner wall 40, as shown in FIGS. 2 and 3 of the drawings, has an internally threaded perimeter 52 which accepts an outer threaded shower dispersal disk 50*a* to disperse a stream of water to form a spray pattern. The area defined by the inner surface 46 of the inner wall 40 and the outer threaded shower dispersal disk 50*a* is the main cavity 60 of the invention 10, wherein the greatest majority of the water flowing through the invention 10 is maintained. Water introduced into the novelty shower head 10, in a small proportion, passes into the turbulence cavity 70, with the majority of the water entering the main cavity 60. That water entering the main cavity 60 is transferred directly through the outer threaded shower dispersal disk 50*a* onto the person showering. That water entering the turbulence cavity 70 through the water entry port swirls within the turbulence cavity 70 and exits through the water exit ports 74 and the drain port 76 into the main cavity 60 which is expelled onto the person showering. The floating objects 80 should be small enough to move freely within the turbulence cavity 70, but should be large enough to be kept from exiting the turbulence cavity 70 through the water entry ports 72, the threaded cleaning port holes 34, the water exit ports 74 or the drain port 76, thus causing the floating objects 80 to be permanently retained within the turbulence cavity 70.

The turbulence cavity 70 contains the plurality of floating objects 80 of varied shape and color which react to the swirling water in the turbulence cavity 70 by moving about erratically with the disruptive flow of water in the turbulence cavity 70. These floating objects 80 should be made of water proof, mildew-resisting material. After the shower is not being used, any remaining water in the turbulence cavity 70 is drained out of the cavity through the singular drain port 76, allowing the floating objects 80 to dry.

Periodically during the use of the invention 10, a cleaning solution is recommended to be introduced into the turbulence cavity 70 through the threaded cleaning port holes 34 to prevent mineral deposit and mildew from forming within the turbulence cavity 70.

Figure 4:
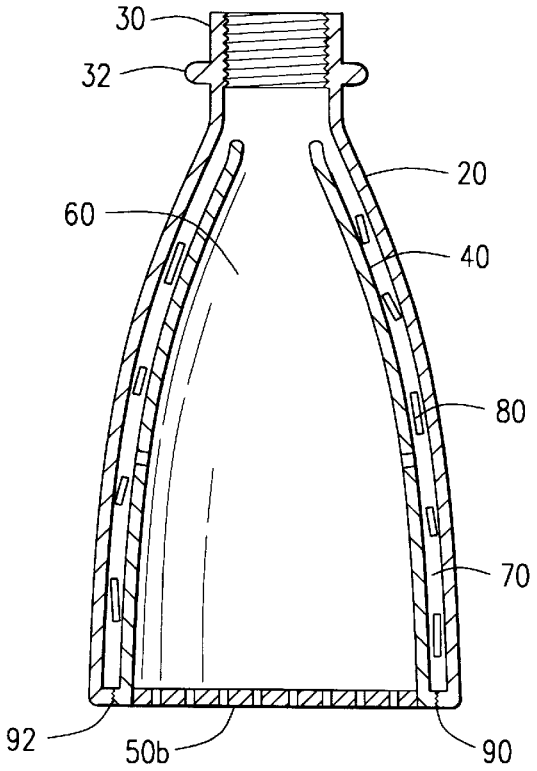
FIG. 4 is a cross section of the second embodiment of the invention.

In a second embodiment of the invention, as shown in FIG. 4 of the invention, the inner wall 40 of the invention and the transparent outer wall 20 of the invention are threadably connected by an inner thread 90 on the inner surface 26 of the transparent outer wall 20 at the lower portion 24 of such transparent outer wall 20 and an outer thread 92 on the lower portion 44 of the outer surface 48 of the inner wall 40. The transparent outer wall 20 in this second embodiment does not need to have any threaded cleaning port holes 34. The inner wall 40 in this second embodiment does have identical water exit ports 74 as in the first embodiment and is also provided with a drain port 76. Again, as in the first embodiment of the invention, the upper portion 42 of the inner wall 40 is closer to the upper portion 22 of the transparent outer wall 20, causing the turbulence cavity 70 to be restricted towards the upper portion 42 of the inner wall 40.

A different shower dispersal disk 50*b*, not necessarily threadably engaged, is affixed to the inner wall 40 at the lower portion 44 of the inner surface 46. The area defined by the inner surface 46 of the inner wall 40 and the shower dispersal disk 50*b* is the main cavity 60 of the second embodiment of the invention, wherein the greatest majority of the water flowing through the invention 10 is located. Water introduced into the novelty shower head 10, in a small proportion, passes into the turbulence cavity 70. That remaining majority of the water enters the main cavity 60 and is transferred directly through the shower dispersal disk 50*b* onto the person showering.

That water entering the turbulence cavity 70 through the water entry port 72 swirls within the turbulence cavity 70 and exits through the water exit ports 74 and the drain port 76 into the main cavity 60 also being expelled onto the person showering. The floating objects 80 should again be small enough to move freely within the turbulence cavity 70, but should be large enough to be kept from exiting the turbulence chamber 70 through the water entry ports 72, the water exit ports 74 or the drain port 76, thus causing the floating objects 80 to be retained within the turbulence cavity 70.

The turbulence cavity 70 contains the plurality of floating objects 80 of varied shape and color which react to the swirling water in the turbulence cavity 70 by moving about erratically with the disruptive flow of water in the turbulence cavity 70. These floating objects 80 should be made of water proof, mildew-resisting material. After the shower is not being used, any remaining water in the turbulence cavity 70 is drained out of the turbulence cavity 70 through the singular drain port 76, allowing the floating objects 80 to dry.

Periodically, the inner wall 40 and the transparent outer wall 20 should be separated from each other the allow access into the turbulence cavity 70 to clean the floating objects 80 and the turbulence cavity 70 from any build up of minerals or mildew. When clean, the floating objects 80 are replaced within the turbulence cavity 70 as the inner wall 40 and transparent outer wall 20 are reattached.

While the invention has been particularly shown and described with reference to a preferred embodiment thereof, it will be understood by those skilled in the art that changes in form and detail may be made therein without departing from the spirit and scope of the invention.

What is claimed is:

1. A novelty shower head for attaching to an outer threaded shower pipe in a bathroom, the novelty shower head comprising:

a. an internally threaded shower head attachment having an extended flange;

b. a transparent outer wall, having an upper portion, a lower portion, an inner surface and an outer surface;

c. an inner wall having an upper portion, a lower portion, in inner surface and an outer surface; and d. an outer threaded shower dispersal disk attaching to the lower portion of the inner surface of the inner wall by inner threads supplied within the inner surface of the inner wall, the lower portion of the inner surface of the transparent outer wall and the lower portion of the outer surface of the inner wall being attached, defining a turbulence cavity between the outer surface of the inner wall and the inner surface of the outer wall, such turbulence cavity containing a plurality of floating objects, the turbulence cavity having a water entry port, a plurality of water exit ports through the inner wall and a drain port through the inner wall allowing for the passage of water into a main cavity defined by the inner surface of the inner wall and the outer threaded shower dispersal disk.

2. The shower head as claimed in claim 1, the transparent outer wall further comprising:

at least two threaded cleaning port holes between the inner surface and outer surface of the transparent outer wall, such threaded cleaning port holes having inner threads engaging plugs, the threaded cleaning port holes allowing access to the turbulence cavity.

3. A novelty shower head for attaching to an outer threaded shower pipe in a bathroom, the novelty shower head comprising:

a. an internally threaded shower head attachment having an extended flange;

b. a transparent outer wall, having an upper portion, a lower portion, an inner surface and an outer surface;

c. an inner wall having an upper portion, a lower portion, in inner surface and an outer surface; and d. a shower dispersal disk attached within the lower portion of the inner surface of the inner wall, the lower portion of the inner surface of the transparent outer wall having an inner thread and the lower portion of the outer surface of the inner wall having an outer thread, the inner wall and outer wall thus being threadably attached and defining a turbulence cavity between the outer surface of the inner wall and the inner surface of the outer wall, such turbulence cavity containing a plurality of floating objects, the turbulence cavity having a water entry port, a plurality of water exit ports through the inner wall and a drain port through the inner wall allowing for the passage of water into a main cavity defined by the inner surface of the inner wall and the shower dispersal disk.

* * * * *